US008425008B2

(12) United States Patent
Kudo et al.

(10) Patent No.: US 8,425,008 B2
(45) Date of Patent: Apr. 23, 2013

(54) LIQUID DISCHARGE HEAD AND RECORDING APPARATUS USING THE SAME

(75) Inventors: Kiyomitsu Kudo, Machida (JP); Yukuo Yamaguchi, Tokyo (JP); Mikiya Umeyama, Tokyo (JP); Satoshi Kimura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 877 days.

(21) Appl. No.: 12/547,257

(22) Filed: Aug. 25, 2009

(65) Prior Publication Data

US 2010/0046012 A1 Feb. 25, 2010

(30) Foreign Application Priority Data

Aug. 25, 2008 (JP) ..... 2008-215698

(51) Int. Cl.
*B41J 2/01* (2006.01)

(52) U.S. Cl.
USPC ..... 347/50

(58) Field of Classification Search ..... None
See application file for complete search history.

(56) References Cited

U.S. PATENT DOCUMENTS 6,910,759 B2 6/2005 Kawamura
2002/0180823 A1* 12/2002 Shinada et al. ..... 347/19

FOREIGN PATENT DOCUMENTS

JP 2004-266456 9/2004

* cited by examiner

*Primary Examiner* — Jerry Rahll
(74) *Attorney, Agent, or Firm* — Canon USA Inc. IP Division

(57) ABSTRACT

A liquid discharge head that is detachably attached to a recording apparatus includes a liquid discharge substrate, a planar region including a plurality of connection terminals that electrically connect the liquid discharge head to the recording apparatus by sliding relative to the recording apparatus while turning when mounted on the recording apparatus, and definition portions defining a rotational center. The planar region is disposed parallel to the rotational center. Among the plurality of connection terminals, the connection terminal disposed closer to the rotational center is longer in a direction perpendicular to the rotational center and parallel to the planar region than the connection terminal disposed more distant from the rotational center.

19 Claims, 9 Drawing Sheets

LIQUID DISCHARGE HEAD AND RECORDING APPARATUS USING THE SAME

BACKGROUND OF THE INVENTION

1. Field of the Invention

The present invention relates to a liquid discharge head that discharges a liquid such as ink to perform recording on a recording medium and a recording apparatus using the same, and more particularly to a liquid discharge head and a recording apparatus that perform ink jet recording.

2. Description of the Related Art

FIG. 9 illustrates a conventional ink jet recording head (hereinafter referred to as a recording head) 1 used in an ink jet recording apparatus that discharges ink toward a recording medium such as paper, plastic sheets, and overhead projector (OHP) sheets to perform recording based on recording information (U.S. Pat. No. 6,910,759).

The recording head 1 illustrated in FIG. 9 includes recording element substrates 2 and 3 for discharging ink from a discharge port, and an ink supply unit 15, having an ink supply path formed therein, for supplying ink to the recording element substrates 2 and 3 from an ink tank (not illustrated), which is detachably attached to the recording head 1. Such recording heads are mounted on carriages in ink jet recording apparatuses, to perform recording.

The recording head 1 includes a plurality of contact pads 5 that comes into contact with a contact connector (not illustrated) provided in the carriage in the recording apparatus when the recording head 1 is mounted on the carriage. A driving signal for driving a recording element supplied from the recording apparatus through the contact pads 5 is transmitted to the recording element substrates 2 and 3.

The recording head 1 further includes two guide portions 9 serving as a guide member when mounted on the carriage in the recording apparatus.

Furthermore, the recording head 1 illustrated in FIG. 9 includes an X-direction abutting portion 16, a Y-direction abutting portion 17, and a Z-direction abutting portion 18 such that it is positioned along three axes of an orthogonal coordinate system with respect to the recording apparatus. The abutting portions 16, 17, and 18 are abutted against a positioning reference in a convex shape, for example, provided in the carriage in the recording apparatus.

The recording head 1 turns around an axis passing through the two guide portions 9 when mounted on the carriage so that the contact pads 5 in the recording head 1 come into contact with the contact connector in the carriage and the abutting portions 16, 17, and 18 abut on the positioning reference in the carriage. The contact connector in the carriage can be pushed by the contact pads 5 in the recording head 1. Thus, the recording head 1 is mounted on the recording apparatus.

In recent years, ink jet recording apparatuses have become increasingly miniaturized, and recording heads have been required to be also miniaturized along with the miniaturization of the recording apparatuses.

The recording heads are thus turned and detachably attached to the recording apparatuses, and the contact pads can press the contact connectors. In mounting the recording heads, therefore, contact connectors and contact pads come into contact with each other before the mounting of the recording heads is completed. The contact connectors and the contact pads keep contact with each other in a turning direction of the recording heads, from the time when the contact connectors and the contact pads start to come into contact with each other until the mounting of the recording heads is completed.

Regions where the contact pads thus come into contact with the contact connectors when the recording heads are mounted shall be referred to as contact regions. The contact regions have length components along directions perpendicular to axes serving as rotational centers.

In order to increase the number of contact pads while miniaturizing the recording heads, along with miniaturization of the contact pads, the arrangement densities of the contact pads increase, and the relative lengths of the contact regions increase as to the contact pads.

When the relative lengths of the contact regions as to the contact pads become larger than in the conventional apparatus, the contact regions do not stay within the contact pads, which is a problem. More specifically, the contact pads start to come into contact with the contact connectors in portions (wiring substrates) other than the contact pads with which the contact connectors should come into contact when the recording heads are mounted. Therefore, surfaces of the wiring substrates and the contact pads are damaged so that the electrical reliabilities of the recording heads may be degraded.

SUMMARY OF THE INVENTION

The present invention is directed to an inkjet recording head that shows high reliability of electrical connection to a recording apparatus even when the length of a contact region with respect to a contact pad in an ink jet recording head becomes relatively larger.

According to an aspect of the present invention, a liquid discharge head that is detachably attached to a recording apparatus includes a liquid discharge substrate, a planar region including a plurality of connection terminals that electrically connect the liquid discharge head to the recording apparatus by sliding relative to the recording apparatus while turning when mounted on the recording apparatus, and definition portions defining a rotational center. The planar region is disposed parallel to the rotational center. Among the plurality of connection terminals, the connection terminal disposed closer to the rotational center is longer in a direction perpendicular to the rotational center and parallel to the planar region than the connection terminal disposed more distant from the rotational center.

In the above-mentioned configuration, the length of the contact pad closer to an axis serving as the rotational center is larger in a direction of the length of the contact region. Therefore, a liquid discharge head can be realized that shows high reliability of electrical connection to the recording apparatus.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

In the present specification, "recording" involves not only the formation of significant information such as characters and graphics but also the formation of information regardless of whether the information is significant or insignificant and whether or not the information becomes apparent so as to be visually perceivable by human beings. Furthermore, "recording" broadly involves the formation of images, figures, patterns, and others on a recording medium or the processing of a recording medium.

"Recording medium" include not only paper used in general recording apparatuses but also cloth, plastic film, metal plate, glass, ceramics, wood, leather, and others that can receive ink.

Furthermore, the definition of "ink" should be broadly interpreted, similarly to the definition of "recording". "Ink" includes a liquid that can be supplied to form images, figures, patterns, and others, or is usable in processing a recording medium, or processing ink. Therefore, "ink" involves all liquids that can be used for recording.

FIGS. 6 and 7 are diagrams illustrating an ink jet recording head (hereinafter referred to as a recording head) 111 as an example of a liquid discharge head according to an exemplary embodiment of the present invention.

Figure 6A:
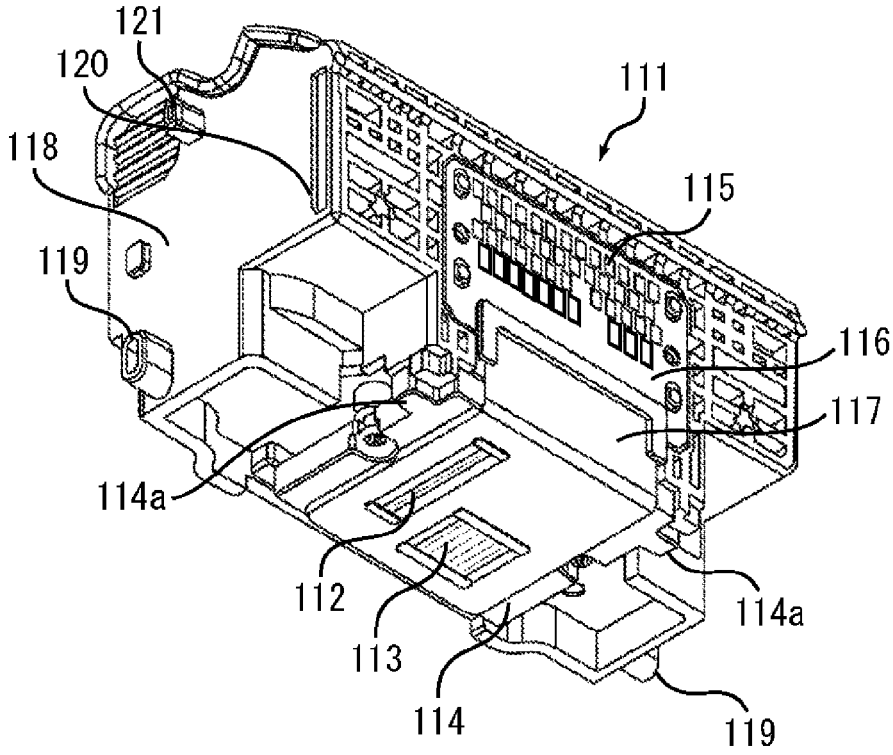
FIGS. 6A and 6B are diagrams illustrating a recording head as an example of the embodiment of the present invention.
Figure 6B:
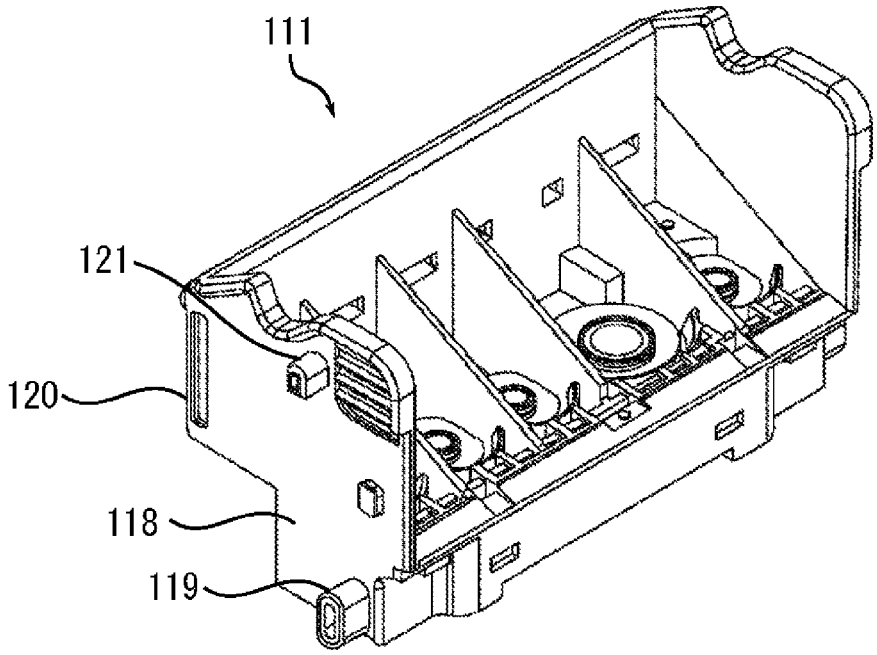
Figure 7A:
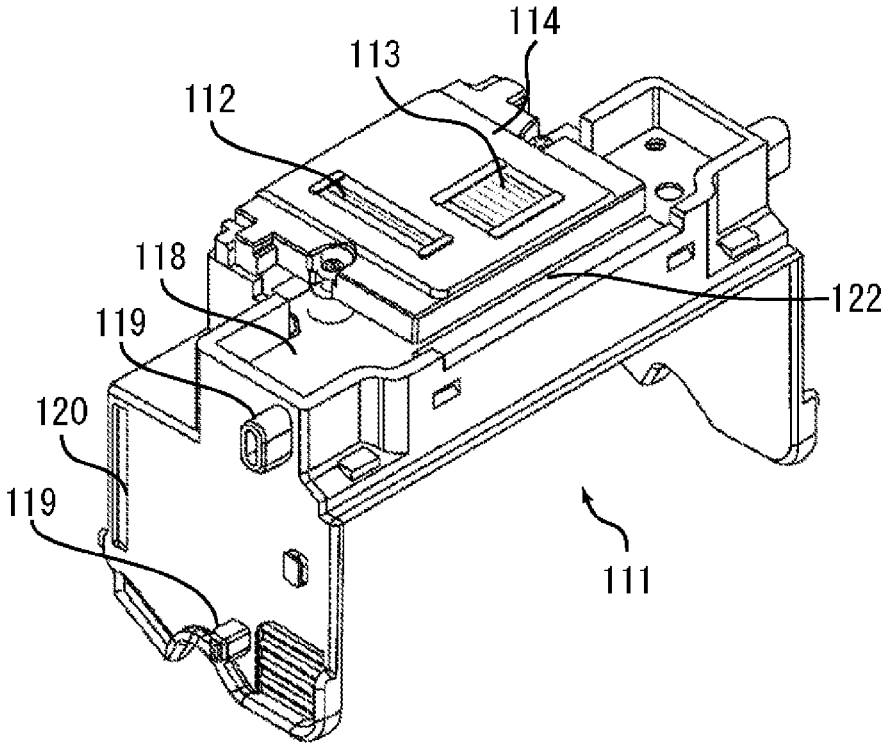
FIGS. 7A and 7B are diagrams illustrating a recording head as an example of the embodiment of the present invention.
Figure 7B:
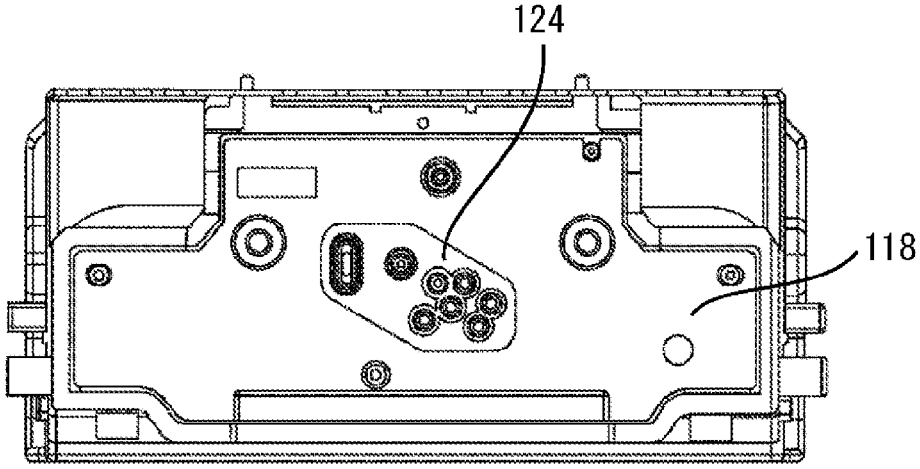

FIG. 6A is a perspective view illustrating the recording head 111 as viewed from the side on which a wiring substrate 116 is provided, and FIG. 6B is a perspective view illustrating the recording head 111 as viewed from the side on which an ink tank is mounted. FIG. 7A is a perspective view illustrating the recording head 111 as viewed from the side on which recording element substrates 112 and 113 serving as a liquid discharge substrate are provided, and FIG. 7B is a perspective view illustrating the recording head 111 as viewed from the side on which a recording element unit 114 is provided, where the recording element unit 114 is not illustrated.

As illustrated in FIG. 6A, the recording head 111 includes a recording element unit 114 including a recording element substrate 112 for black ink discharge and a recording element substrate 113 for color ink discharge, and a plurality of contact pads 115 serving as a connection terminal that makes electrical connection to the recording apparatus.

The recording head 111 further includes a wiring substrate 116 including the plurality of contact pads 115, a wiring tape 117 connecting the wiring substrate 116 and the recording element unit 114 to each other, and a flow path member 118 having a flow path for supplying ink in an ink tank (not illustrated) to the recording element unit 114.

The recording head 111 includes two guide portions 119 serving as a guide member when mounted on a carriage in the recording apparatus. The guide portions 119 have a convex shape projecting on side surfaces of the recording head 111. A sub-guide portion 121 is provided above the guide portions 119, to perform the function of preventing erroneous insertion in mounting the recording head 111 on the carriage.

The recording element unit 114 is provided with abutting portions 114*a* that abuts on a positioning reference (C112 in FIG. 2) provided in the carriage in the recording apparatus.

A thin-walled slit 120 aiming at stabilizing the forming of the flow path member 118 is provided on a side surface of the flow path member 118.

As illustrated in FIG. 7A, a step portion 122 is provided in the flow path member 118 between the recording element unit 114 and the flow path member 118. Even in models having recording element units 114 that differ in size, flow path members 118 can have an equal external shape owing to step portions 122. Thus, the step portion 122 makes it easy to share a production line, which enables the production of cheaper recording heads.

As illustrated in FIG. 7B where the recording element unit 114 is not shown, a joint seal 124 is provided to connect the recording element unit (not illustrated) and the flow path member 118 to each other. As illustrated in FIG. 7B, the external shape of the joint seal 124 has no inward corners, to achieve miniaturization.

Exemplary embodiments of the present invention will be described in detail with reference to FIGS. 1 to 5B.

Figure 1:
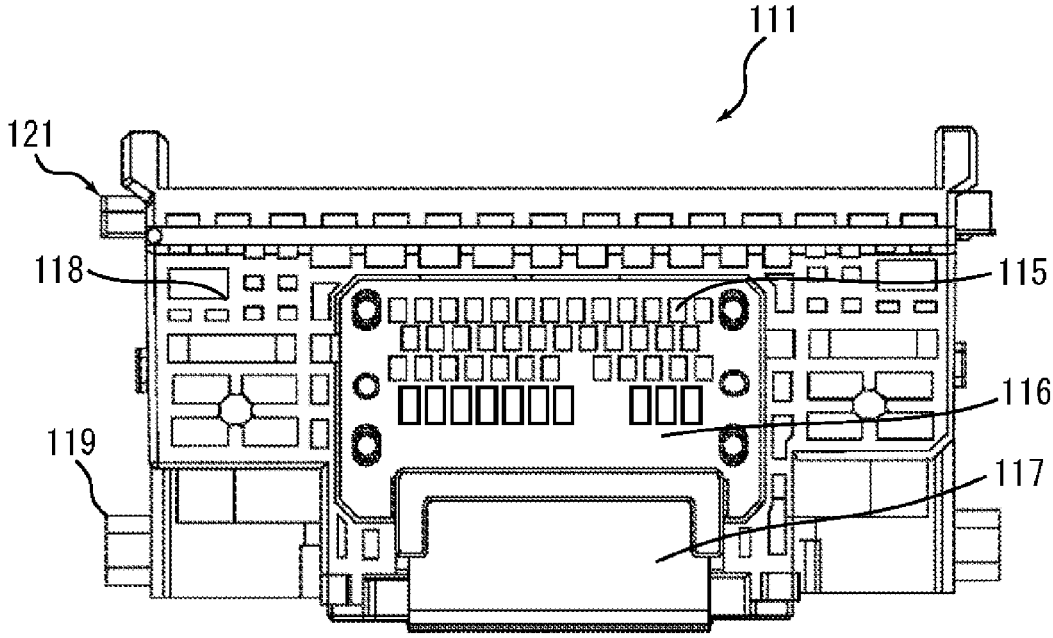
FIG. 1 is a diagram illustrating a recording head in a first exemplary embodiment of the present invention.

FIG. 1 is a diagram illustrating a recording head 111 according to a first exemplary embodiment of the present invention as viewed from the side on which a wiring substrate 116 is provided.

Forty nine contact pads 115 in four contact pad rows (connection terminal rows) are in a staggered arrangement on the wiring substrate 116 including a planar region. The contact pads 115 arranged in the contact pad row closest to the guide portions 119 have a width of 1.6 mm and a length of 2.6 mm, and the contact pads 115 in the other contact pad rows have a width of 1.6 mm and a length of 2.2 mm. The distance between the contact pads 115 is 0.8 mm in the transverse direction and 0.4 mm in the longitudinal direction.

Thus, the contact pads 115 are miniaturized and the pitch between the contact pads 115 is narrowed so that the wiring substrate 116 can be miniaturized, which enables the reduction in the height of the recording head 111.

Figure 2A:
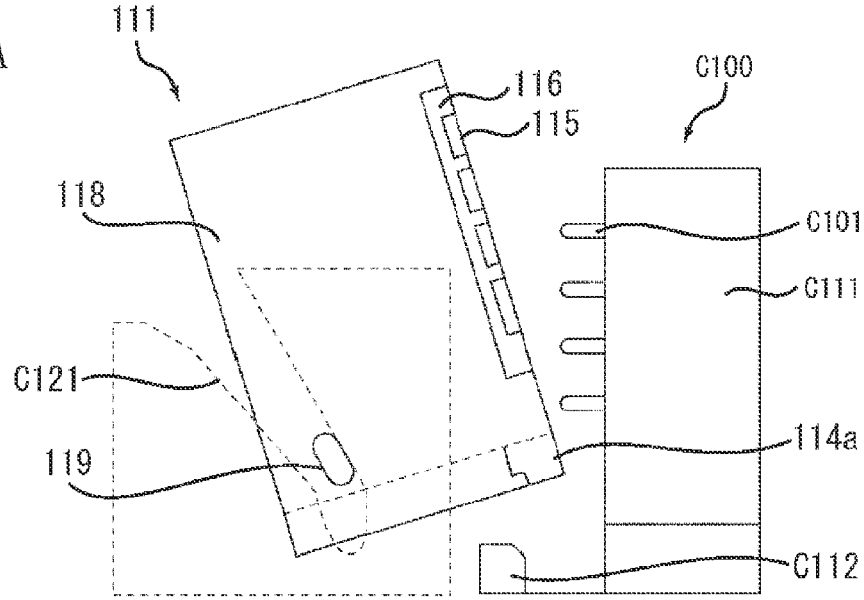
FIGS. 2A, 2B, and 2C are diagrams illustrating the processes of mounting the recording head illustrated in FIG. 1 on a carriage.
Figure 2B:
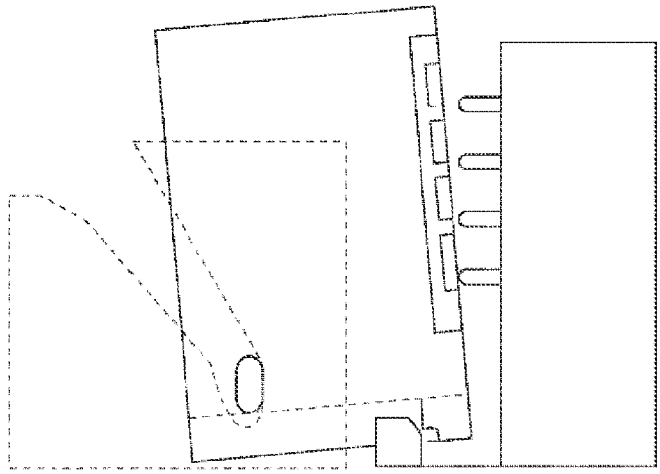
Figure 2C:
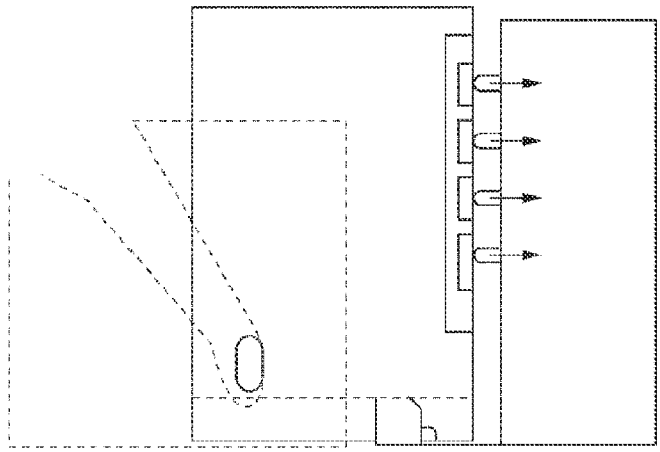

FIGS. 2A to 2C are schematic views illustrating the processes of mounting the recording head 111 according to the first exemplary embodiment of the present invention on a carriage C100 provided in a recording apparatus. A contact connector C101 in the carriage C100 is provided in a connector base C111, and is displaceable in a pushing direction.

The contact connector C101 in the present exemplary embodiment projects by 1.5 mm from the connector base C111, and a range from 0.1 mm to 1.1 mm by which the contact connector C101 is pushed into the connector base C111 is a contact assurance region. Furthermore, the carriage C100 includes a guide rail C121 for guiding guide portions 119.

As illustrated in FIGS. 2A to 2C, the guide portions 119 are guided by the guide rail C121 to turn around a straight line passing through the two guide portions 119 as a rotational center (hereinafter referred to as a rotational axis) so that the recording head 111 is mounted on the carriage C100. More specifically, the recording head 111 is electrically connected to the recording apparatus by sliding relative to the carriage C100 while turning.

The guide portions 119 thus function as a guide member in mounting the recording head 111 on the carriage C100 and definition portions defining a rotational axis of the recording head 111. In the present exemplary embodiment, the guide portions 119 are provided outside an arrangement region of the contact pads 115 along a direction parallel to a wiring substrate 116 and perpendicular to the straight line passing through the two guide portions 119. However, the guide portions 119 are not necessarily provided outside the arrangement region of the contact pads 115. Alternatively, the guide portions 119 may be provided inside the arrangement region of the contact pads 115.

However, if the guide portions 119 are provided not inside but outside the arrangement region of the contact pads 115 as in the present exemplary embodiment, the recording head 111 and the carriage C100 can be prevented from interfering with each other in the process of mounting the recording head 111 on the carriage C100. Although in the present exemplary embodiment, the convex-shaped guide portions 119 are provided on side surfaces of the recording head 111, as described in FIGS. 6A and 6B, the guide portions 119 need not have a convex shape and may be provided in a place different from the side surfaces of the recording head 111, provided that the axis serving as a rotational center of the recording head 111 can be defined. For example, the guide portions 119 may be so adapted that a groove is provided in the recording head 111 along the axis serving as the rotational center and a stick-shaped member corresponding to the groove is provided in the carriage.

As illustrated in FIG. 2A, the carriage C100 is provided with a positioning reference C112 on which an abutting portion 114*a* in the recording head 111 abuts. In the present exemplary embodiment, the recording head 111 turns around the straight line passing through the two guide portions 119 as an axis when mounted on the carriage C100. Therefore, interference is liable to occur between the abutting portion 114*a* in the mounted recording head 111 and the positioning reference C112 in the carriage C100. In order to reduce the interference, the abutting portion 114*a* and the guide portions 119 may be spaced apart along the direction perpendicular to the planar region in the wiring substrate 116, as illustrated in FIG. 2A.

More specifically, the abutting portion 114*a* is provided on the side of the wiring substrate 116 including the contact pads 115, and the guide portions 119 is provided on the side opposite to the wiring substrate 116, so that the distance from the rotational axis to the abutting portion 114*a* is increased. Thus, the radius of a circular arc, which is a track made at the time of mounting the abutting portion 114*a*, is increased to enable the reduction in the above-mentioned interference.

As illustrated in FIG. 2B, the contact pads 115 and the contact connectors C101 are electrically connected to each other beginning from the contact pad 115 which is disposed closer to the guide portion 119, and the contact pads 115 are dragged by the contact connector C101.

As illustrated in FIG. 2C, the contact connector C101 is pushed in by approximately 0.5 mm when the electrical connection is completed. A reaction force of the contact connector C101 at this time is approximately 40 g per pin.

Figure 3:
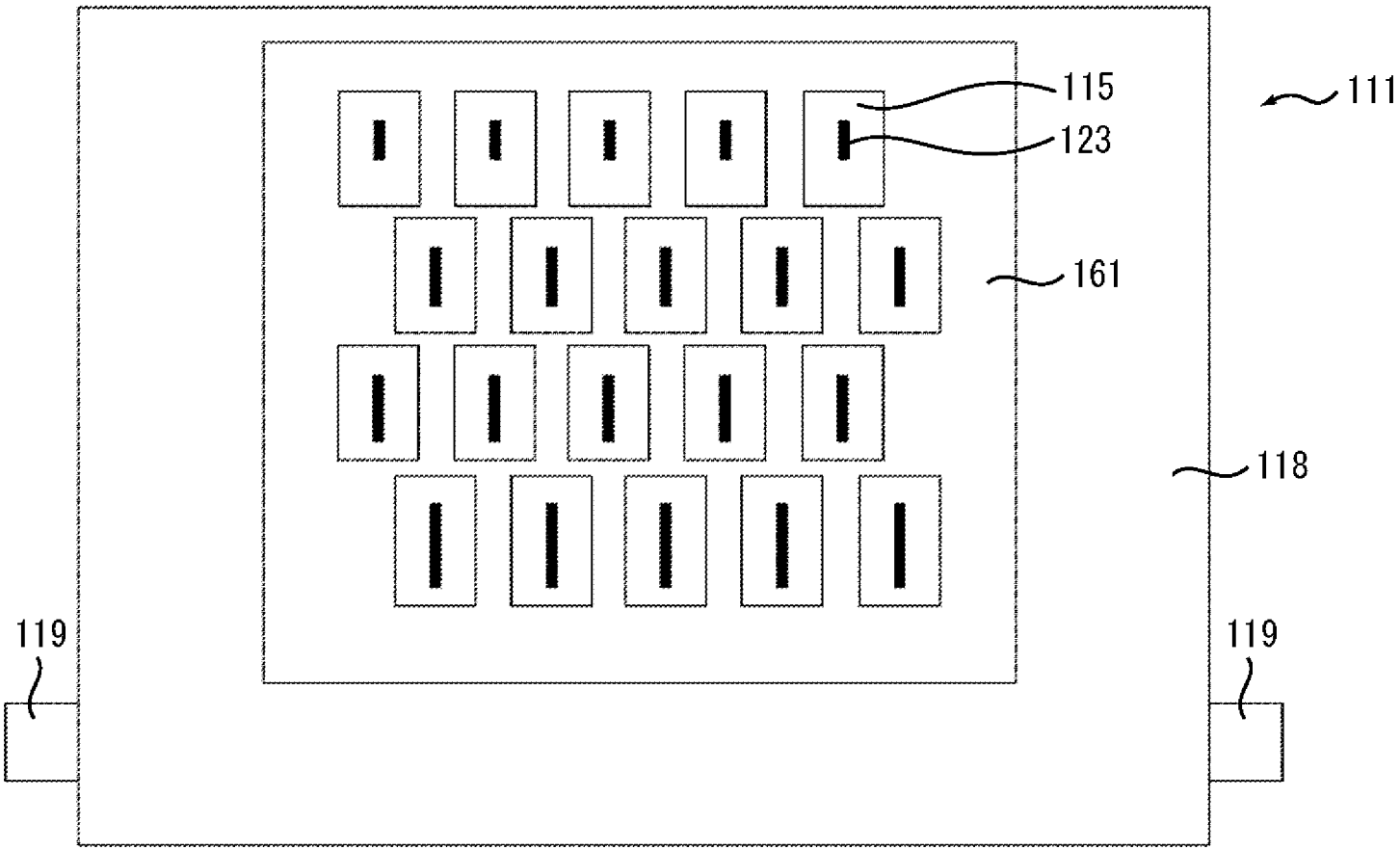
FIG. 3 is a schematic view illustrating the state of contact pads in the recording head in the first exemplary embodiment of the present invention.

FIG. 3 is a schematic view of the recording head 111 illustrating a state of regions (contact regions) 123 where the contact pads 115 in the recording head 111 illustrated in FIG. 2 come into contact with the contact connector C101 when the recording head 111 is mounted.

In FIG. 3, the guide portions 119 are positioned below the contact regions 123 which contact the contact connector C101. As can be seen from FIG. 3, the closer the contact pad 115 is to the guide portions 119, the longer the contact region 123 in the contact pad 115 is.

In the present exemplary embodiment, the contact region 123 in the contact pad 115 closest to the guide portions 119 has a length of approximately 0.9 mm, and the contact regions 123 have lengths of approximately 0.8 mm, approximately 0.75 mm, and approximately 0.7 mm in an upward direction.

In the present exemplary embodiment, the contact pads 115 closer to the guide portions 119 where the contact regions 123 are longer, are made longer than the other contact pads 115 so that the contact pad 115 can come into contact with the contact connector C101 within the contact pad 115. This prevents the contact region 123 from transgressing the contact pad 115. This can suppress electrical short circuit and open circuit within the wiring substrate 116 caused by the contact of the contact connector C101 with the wiring substrate 116 outside the contact pad 115, and the possibility of corrosion of the wiring substrate 116 is reduced. Accordingly, electrically reliable recording heads can be realized with a configuration as illustrated in the present exemplary embodiment.

Figure 4:
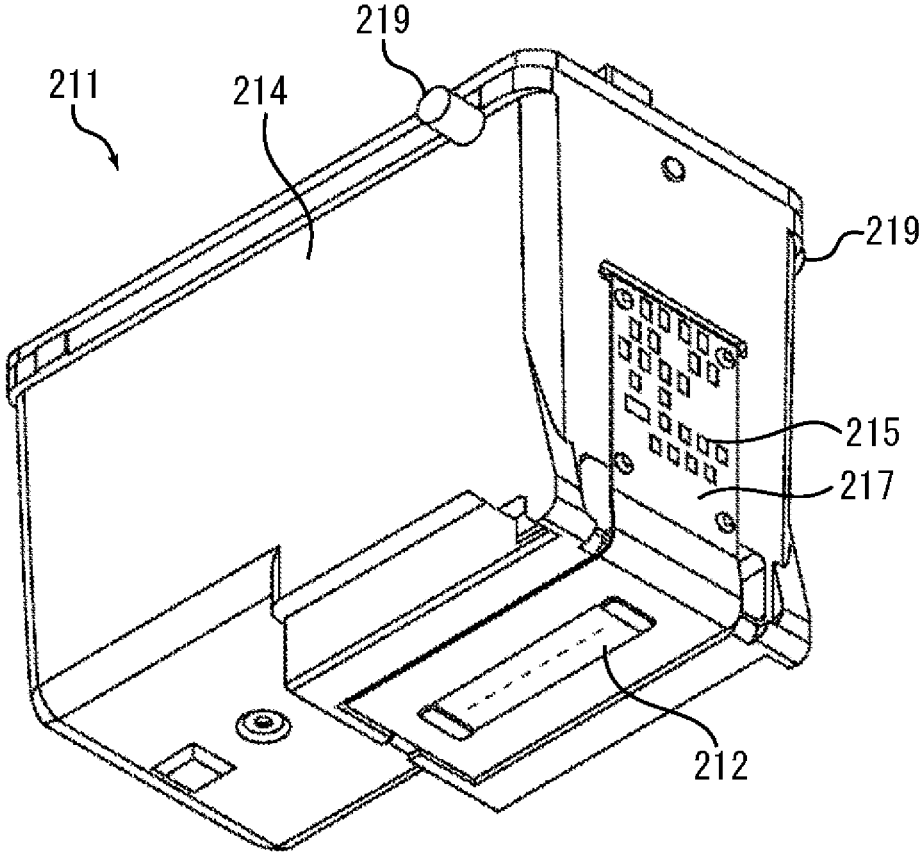
FIG. 4 is a perspective view of a recording head in a second exemplary embodiment of the present invention.

FIG. 4 illustrates a recording head 211 according to a second exemplary embodiment of the present invention.

The recording head 211 in the present exemplary embodiment includes a recording element substrate 212 for discharging ink in response to an electrical signal from a recording apparatus, and a wiring tape 217 having a plurality of contact pads 215 for making electrical connection to the recording apparatus. The recording head 211 further includes an ink tank 214 storing ink to be supplied to the recording element substrate 212. The recording head 211 and the ink tank 214 are integrated.

The recording head 211 includes convex-shaped guide portions 219, and can be mounted on and electrically connected to the recording apparatus by sliding relative to a carriage (not illustrated) in the recording apparatus while turning around a straight line passing through the two guide portions 219 as a rotational axis, as in the first exemplary embodiment.

Figure 5A:
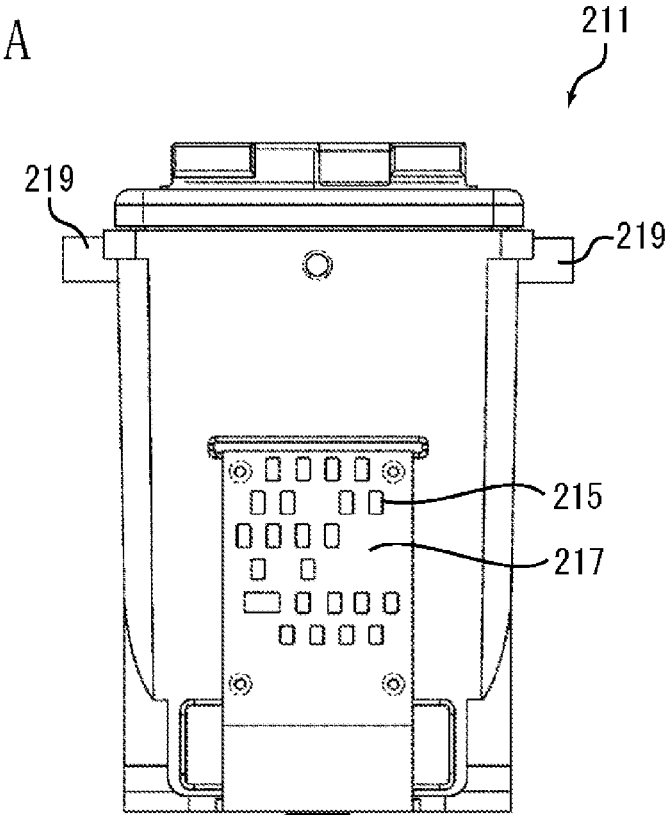
FIGS. 5A and 5B are diagrams illustrating the recording head in the second exemplary embodiment of the present invention.

FIG. 5A is a diagram illustrating the recording head 211 according to the second exemplary embodiment of the present invention as viewed from the side on which the contact pads 215 are provided. Twenty three contact pads 215 in six rows are arranged in the wiring tape 217.

With respect to the width along the rotational axis, the contact pad 215 that makes electrical connection to the recording apparatus has a width of 1 mm, and the other contact pads 215 for test use have widths of 2.4 mm and 0.8 mm.

With respect to the length in a direction perpendicular to the rotational axis, the uppermost contact pad 215 closest to the guide portions 219 has a length of 1.7 mm. The length of the contact pads 215 decreases by 0.1 mm one by one in an upward direction, and the lowermost contact pad 215 has a length of 1.2 mm. The distance between the contact pads 215 is at minimum 1.0 mm in the transverse direction and 0.6 mm to 1.0 mm in the longitudinal direction.

Thus, the contact pads 215 are miniaturized and the pitch between the contact pads 215 is narrowed, so that the wiring tape 217 can be miniaturized, which enables the reduction in the cost of the wiring tape 217, enabling the reduction in the height of the recording head 211.

Figure 5B:
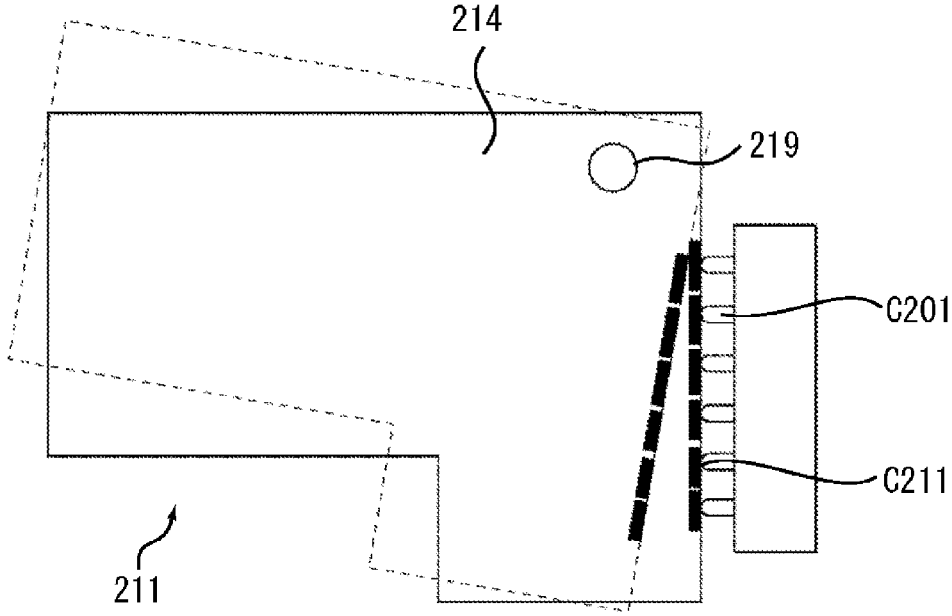

FIG. 5B is a schematic view illustrating the process of mounting the recording head 211 according to the second exemplary embodiment of the present invention on a carriage (not illustrated) in the recording apparatus. A contact connector C201 in the carriage is provided in a connector base C211, and is displaceable in a pushing-in direction.

The contact connector C201 in the present exemplary embodiment projects by 1.5 mm from the connector base C211, and a range from 0.1 mm to 1.1 mm by which the contact connector C201 is pushed into the connector base C211 is a contact assurance region. A broken line indicates the recording head 211 that is being inserted into the carriage, and a solid line indicates the recording head 211 that has been mounted on the carriage.

In the second exemplary embodiment, the recording head 211 is also mounted on the carriage while turning around the straight line passing through the two guide portions 219 as a rotational axis, as illustrated in FIG. 5B, like in the first exemplary embodiment. The contact pads 215 and the contact connector C201 are electrically connected to each other beginning from the contact pads 215 which are disclosed closer to the guide portions 219, and the contact pads 215 are dragged by the contact connector C201. The contact connector C201 is pushed in by approximately 0.5 mm when the mounting is completed. A reaction force of the contact connector C201 at this time is approximately 40 g per pin.

In the second exemplary embodiment, the length of contact regions contacting the contact connector C201 increases as the contact regions move up closer to the guide portions 219. Therefore, the length of the contact pad 215 is increased as the length of the contact region is increased. In such a configuration, the contact pad 215 can come into contact with the contact connector C201 within the contact pad 215. This prevents the contact region from transgressing the contact pad 215. This can suppress electrical short circuit and open circuit within a wiring tape 217 due to the contact of the contact connector C201 with a wiring substrate outside the contact pad 215, and the possibility of corrosion of the wiring tape 217 can be reduced. Accordingly, electrically reliable recording heads can be realized.

As described in the foregoing, in the second exemplary embodiment, the farther the contact pad row is away from the rotational axis defined by the guide portions 219, the smaller the length of the contact pad in the contact pad row becomes. However, the length of the contact pad 215 in an adjacent contact pad row does not need to become smaller as it recedes from the guide portions 219. For example, in a recording head including four or more contact pad rows, in a direction along the length of a contact region, the length of a contact pad row closest to guide portions may be made larger than the length of a contact pad row farthest away from the guide portions. More specifically, the effect of the present invention is produced even if the lengths of the two or more contact pad rows positioned between the contact pad row farthest away from and the contact pad row closest to the guide portions are the same.

Now, a recording apparatus will be described on which the recording head according to the explanatory embodiment of the present invention can be mounted.

Figure 8:
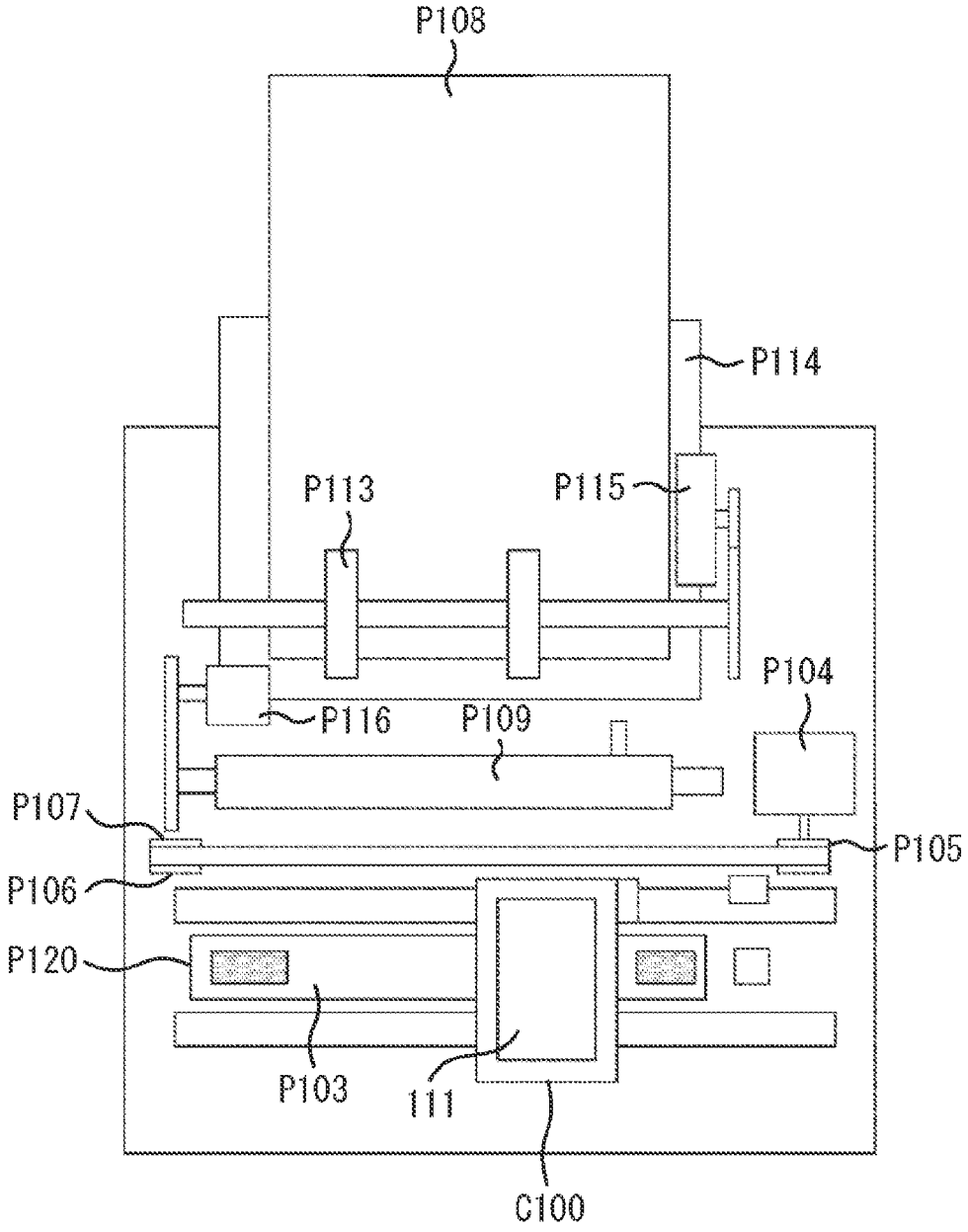
FIG. 8 is a diagram illustrating a recording apparatus on which the recording head according to the explanatory embodiment of the present invention can be mounted.
Figure 9:
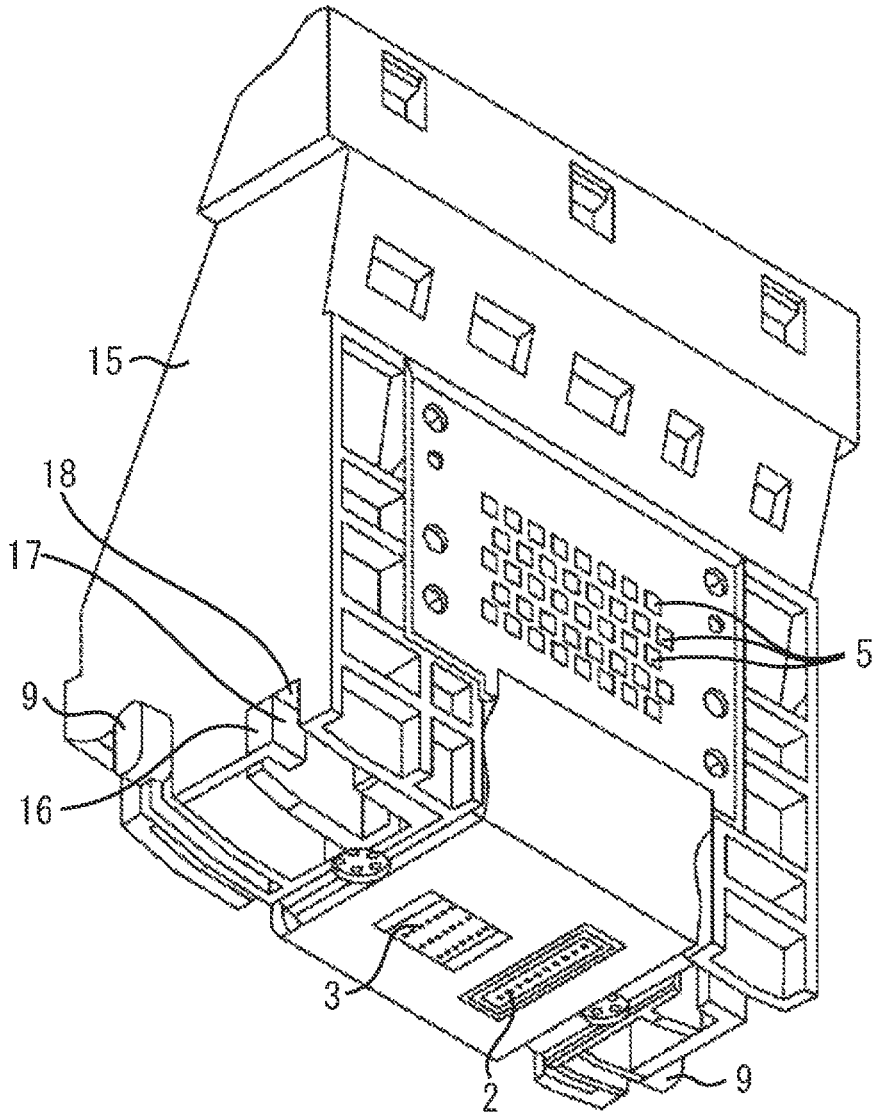
FIG. 9 is a diagram illustrating a conventional recording head.

FIG. 8 is a schematic plan view giving an internal overview of an example of the recording apparatus on which the recording head according to the explanatory embodiment of the present invention can be mounted.

In a configuration illustrated in FIG. 8, the recording head 111 (FIGS. 1 and 6) is replaceably mounted on the carriage C100. The recording head 111 may also have the configuration of the recording head 211 (FIG. 4) which integrally includes the ink tank storing ink to be supplied thereto.

The carriage C100 extends in a main scanning direction and is guided and supported so as to be reciprocally movable along a guide shaft P103 installed in an apparatus body. The carriage C100 is driven by a main scanning motor P104 via a driving mechanism such as a motor pulley P105, a driven pulley P106, and a timing belt P107 while the position and the movement of the carriage C100 are controlled.

Recording mediums P108 such as recording paper sheets and plastic sheets are separately fed one by one from an automatic sheet feeder P114 by a pick-up roller P113 which is rotated by a feeding motor P115 via a gear. Furthermore, the recording mediums P108 are conveyed (sub-scanned) through positions opposing the recording element substrates 112 and 113 (FIGS. 6A and 7A) in the recording head 111, by the rotation of a conveyance roller P109. The conveyance roller 109 is driven by transmitting the rotation of a sub-scanning motor P116 via the gear.

The reverse surfaces of the recording mediums P108 are supported by a platen P120 such that flat recording surfaces are formed in the recording portions. In this case, the recording head 111 mounted on the carriage C100 is held such that the recording element substrates 112 and 113 project downward from the carriage C100 to be parallel to the recording mediums P108.

The recording head serving as the liquid discharge head described above may be a recording head that discharges ink utilizing thermal energy and has a recording element substrate including an electrothermal converter for generating thermal energy that causes film boiling in the ink. More specifically, to perform recording, the recording head discharges ink from a discharge port in the recording element substrate utilizing the pressure of bubbles formed by the film boiling of the ink caused by the thermal energy, which is applied using the electrothermal converter. It goes without saying that the recording head may be of other types. For example, the recording head may discharge ink by a piezoelectric element.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-215698 filed Aug. 25, 2008, which is hereby incorporated by reference herein in its entirety.

What is claimed is:

1. A liquid discharge head that is attached to a recording apparatus, comprising:

a liquid discharge substrate;

a planar region provided with a plurality of connection terminals that electrically connect the liquid discharge substrate to the recording apparatus by rotating of the liquid discharge head when the liquid discharge head is attached to the recording apparatus; and a definition portion defining a central axis of the rotating, wherein a first connection terminal of the plurality of connection terminals is disposed closer to the axis than a second connection terminal of the plurality of connection terminals, and a length of the first connection terminal in a direction perpendicular to the axis is larger than that of the second connection terminal.

2. The liquid discharge head according to claim 1, wherein among the plurality of connection terminals, the length of the connection terminal disposed closest to the axis is larger than those of the other connection terminals.

3. The liquid discharge head according to claim 1, wherein among the plurality of connection terminals, the length of the connection terminal disposed most distant from the axis is smaller than those of the other connection terminals.

4. The liquid discharge head according to claim 1, wherein of the plurality of connection terminals, one of the two adjacent connection terminals which is disposed closer to the axis, has a length that is not less than the length of another connection terminal disposed more distant from the axis in the direction perpendicular to the axis.

5. The liquid discharge head according to claim 1, wherein the lengths of the connection terminals become larger as they are disposed closer to the axis.

6. The liquid discharge head according to claim 1, further comprising a plurality of connection terminal rows in which the plurality of connection terminals is arranged along the axis.

7. The liquid discharge head according to claim 1, wherein the definition portion is disposed on each of two surfaces of a plurality of surfaces of the liquid discharge head, the two surfaces intersect a surface provided with the planar region and a surface provided with the liquid discharge substrate, and each of the definition portion has a convex shape projecting along the axis.

8. The liquid discharge head according to claim 1, wherein the definition portion is provided outside a region where the plurality of connection terminals is arranged in the direction perpendicular to the axis and parallel to the planar region.

9. The liquid discharge head according to claim 1, wherein the definition portion is provided near the planar region in the direction perpendicular to the planar region.

10. The liquid discharge head according to claim 1, wherein the definition portion is provided far from the planar portion in the direction perpendicular to the planar region.

11. The liquid discharge head according to claim 10, further comprising an abutting portion, which abuts on a positioning reference in the recording apparatus, provided near the planar region in the direction perpendicular to the planar region.

12. A recording apparatus to which the liquid discharge head according to claim 1 is attached, comprising a planar region provided with a plurality of connection terminals that can electrically connect to the plurality of the connection terminals of the liquid discharge head, wherein the plurality of connection terminals of the recording apparatus is displaceable in the direction perpendicular to the planar region of the recording apparatus when the liquid discharge head is attached to the recording apparatus.

13. The liquid discharge head according to claim 1, wherein among the plurality of connection terminals, the length of the connection terminal disposed closest to the axis is larger than that of the connection terminal disposed most distant from the axis.

14. A liquid discharge head that is attached to a recording apparatus, comprising:

a liquid discharge substrate;

a planar region provided with a plurality of connection terminals that electrically connect the liquid discharge substrate to the recording apparatus by rotating of the liquid discharge head when the liquid discharge head is attached to the recording apparatus; and two surfaces intersecting the planar region and each provided with a definition portion configured to define the rotation of the liquid discharge head, wherein a first connection terminal of the plurality of connection terminals is disposed closer to a virtual straight line passing through each of the definition portions than a second connection terminal of the plurality of connection terminals, and a length of the first connection terminal in a direction perpendicular to the virtual straight line is larger than that of the second connection terminal.

15. The liquid discharge head according to claim 14, wherein among the plurality of connection terminals, the length of the connection terminal disposed closest to the virtual straight line is larger than that of the connection terminal disposed most distant from the virtual straight line.

16. The liquid discharge head according to claim 14, wherein among the plurality of connection terminals, the length of the connection terminal disposed closest to the virtual straight line is larger than those of the other connection terminals.

17. The liquid discharge head according to claim 14, wherein the lengths of the connection terminals become larger as they are disposed closer to the virtual straight line.

18. The liquid discharge head according to claim 14, wherein the definition portion has a convex shape projecting along the virtual straight line.

19. A recording apparatus to which the liquid discharge head according to claim 14 is attached, comprising a planar region provided with a plurality of connection terminals that can electrically connect to the plurality of the connection terminals of the liquid discharge head, wherein the plurality of connection terminals of the recording apparatus is displaceable in the direction perpendicular to the planar region of the apparatus when the liquid discharge head is attached to the recording apparatus.

* * * * *